US006670872B2

(12) United States Patent
Kurzmann

(10) Patent No.: US 6,670,872 B2
(45) Date of Patent: Dec. 30, 2003

(54) LOW-VOLTAGE CIRCUIT BREAKER WITH AN ARC-EXTINGUISHER CHAMBER AND A SWITCHING GAS DAMPER

(75) Inventor: Harald Kurzmann, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/312,991

(22) PCT Filed: Jun. 27, 2001

(86) PCT No.: PCT/DE01/02383

§ 371 (c)(1),
(2), (4) Date: May 2, 2003

(87) PCT Pub. No.: WO02/03411

PCT Pub. Date: Jan. 10, 2002

(65) Prior Publication Data

US 2003/0168433 A1 Sep. 11, 2003

(51) Int. Cl.[7] ..... H01H 33/02

(52) U.S. Cl. ..... 335/201; 335/6; 200/306; 218/155; 218/157

(58) Field of Search ..... 335/6, 201, 202; 200/306; 218/34, 35, 52, 155–158, 149–151

(56) References Cited

U.S. PATENT DOCUMENTS

| | | | | |
|---|---|---|---|---|
| 2,310,728 A | | 2/1943 | Bartlett | |
| 5,756,951 A | * | 5/1998 | Manthe et al. | 218/35 |
| 6,100,778 A | * | 8/2000 | Deylitz | 335/201 |
| 6,222,146 B1 | * | 4/2001 | Turkmen | 218/149 |
| 6,388,867 B1 | * | 5/2002 | Rakus et al. | 361/605 |

FOREIGN PATENT DOCUMENTS

| | | |
|---|---|---|
| DE | 7013150 | 7/1970 |
| DE | 3541514 C2 | 5/1987 |
| DE | 3541514 A1 | 5/1987 |
| DE | 19638948 A1 | 3/1998 |
| EP | 0437151 A1 | 7/1991 |
| EP | 0437151 B1 | 7/1991 |

* cited by examiner

*Primary Examiner*—Ramon M. Barrera
(74) *Attorney, Agent, or Firm*—Harness, Dickey & Pierce, P.L.C.

(57) ABSTRACT

A low-voltage circuit breaker (1) has an arc-extinguishing chamber (2) and a switching gas damper (4) which consists of two partial bodies (6, 7) that are displaceable in relation to each other. One (6) of the partial bodies (6, 7) is fixed to the circuit-breaker (1), while the other (7) is pre-stressed against the first partial body (6) with an elastic restoring force (spring 12). The switching gases that; are discharged from the arc-extinguishing chamber (2) are contained inside (8) the switching gas damper (4) until the relative displacement of the partial bodies (6, 7) forms a flow outlet through which the switching gases can escape.

27 Claims, 2 Drawing Sheets

LOW-VOLTAGE CIRCUIT BREAKER WITH AN ARC-EXTINGUISHER CHAMBER AND A SWITCHING GAS DAMPER

This application is the national phase under 35 U.S.C. §371 of PCT International Application No. PCT/DE01/02383 which has an International filing date of Jun. 27, 2001, which designated the United States of America and which claims priority on German Patent Application number DE 100 33 936.0 filed Jul. 5, 2000, the entire contents of which are hereby incorporated herein by reference.

FIELD OF THE INVENTION

The invention generally relates to a low-voltage circuit breaker with an arc extinguishing chamber and with a switching gas damper for absorbing switching gases which emerge from the arc extinguishing chamber. The switching gas damper is preferably detachably mounted on the circuit breaker and has an inlet opening for switching gases which emerge from an outlet opening in the arc extinguishing chamber.

BACKGROUND OF THE INVENTION

A low-voltage circuit breaker is disclosed in DE 35 41 514 C2, with one switching gas damper in each case being provided for each extinguishing chamber of the circuit breaker. EP 0437 151 B1 similarly discloses a switching gas damper of the stated type, which is shared by the extinguishing chambers of a multipole circuit breaker.

A reasonable volume and materials or inserts which are accommodated in the enclosure of the switching gas damper, cool the switching gases and influence their flow are essential for the effect of the known switching gas dampers.

SUMMARY OF THE INVENTION

An embodiment of the invention may be based on an object of providing a switching gas damper with as small a volume as possible and which is more effective.

According to an embodiment of the invention, this object may be achieved in that the enclosure of the switching gas damper includes two body elements which are guided such that they can move relative to one another, of which a first body element is fitted to the circuit breaker and the other body element can be moved against an elastic restoring force relative to the first body element in order to enlarge the internal area which is enclosed by the body elements.

The elastic restoring force has the effect that it is possible to enlarge the internal area of the switching gas damper, starting from a relatively small initial size, under the influence of the switching gases. The switching gas damper thus forms a breathing buffer which is automatically matched to the respectively produced amount of switching gases. DE 196 38 948 A1 has already, per se, disclosed a switching gas damper with an enclosure which comprises body elements which are guided such that they can move relative to one another. However, this switching gas damper is not mounted on the circuit breaker but is fitted to an insert frame, and thus engages with the arc extinguishing chambers only when the circuit breaker is pushed in. With regard to the pressure of switching gases, this switching gas damper behaves rigidly, in the same way as the known switching gas dampers mentioned initially (DE 35 41 514 C2 and EP 0 437 151 B1), because the capability of the body elements to move relative to one another is provided only for tolerance compensation and for sealing between the fixed-position switching gas damper and the moveable circuit breaker.

The "breathing" method of operation of the switching gas damper according to an embodiment of the invention allows different functions, which can be used as required. In particular, the switching gas damper can form a closed system together with the circuit breaker. On the other hand, it may be advantageous for the switching gas damper to have an outlet opening for switching gases, which can be opened by a relative movement of the body elements. After the end of a switching process, the body elements of the switching gas damper return to their basic position, in which the outlet opening is closed.

Both for a "closed" and for an "open" configuration of the switching gas damper, it has been found to be advantageous for the body elements of the switching gas damper to be designed such that they engage in one another telescopically, as is already known per se. In particular, the capability to move telescopically allows advantageous embodiments of outlet openings. In one of these embodiments, edge areas of the mutually overlapping walls of the body elements can be provided with inclined surfaces in the same sense in order to form outlet openings which are aligned at least partially parallel to the walls. Any gas which emerges thus emerges at an angle to the side walls of the circuit breaker, in contrast to a flow which was previously directed directly upward or at right angles to the side.

In a further advantageous embodiment of a switching gas damper, outlet openings are formed by providing the walls of the body elements of the switching gas damper with openings which do not correspond to one another when the body elements are in the basic position and correspond to one another partially or entirely when the body elements are moved relative to one another. This results in a diffuse flow.

The effect of the switching gas damper as a buffer can be further increased by the switching gas damper containing a porous material which can absorb switching gases. A material such as this, preferably of a mineral or metallic nature, provides protection against fluctuations or oscillations of the gas pressure, which may cause undesirable reactions on the extinguishing of the switching arc in the arc extinguishing chamber of the circuit breaker.

The elastic restoring force which acts between the body elements of the switching gas damper can expediently be applied by arranging opposing bearings, which originate from the body elements, for a spring which prestresses the body elements with respect to one another, in the internal area of the switching gas damper, and providing a stop in order to limit the relative movement of the body elements. Although an arrangement of springs such as this is similar to one embodiment of the switching gas damper according to the initially cited DE 196 38 948 A1, the direction in which it acts is actually reversed since, in the context of the invention, the body elements are drawn together and are not spread apart from one another.

With regard to the desired compact structure of the circuit breaker and of the switching gas damper, difficulties arise in arranging said springs sufficiently far away from the inlet opening to preclude contact with corrosive switching gases. According to one development of the invention, this problem can be avoided by at least one of the opposing bearings being designed as a protection body which shields the spring from the internal area of the switching gas damper.

Although the arrangement of outlet openings explained above intrinsically ensures limited relative movement between the body elements, it is recommended, according to a further embodiment of the invention, that the opposing bearings are at the same time to be designed as a stop in order to limit the relative movement of the body elements. This fixes the height of the installation area in the circuit breaker.

BRIEF DESCRIPTION OF THE DRAWINGS

The invention will be explained in more detail in the following text with reference to the exemplary embodiments which are illustrated in the figures.

In an illustration which corresponds to that in FIG. 2.

DETAILED DESCRIPTION OF THE PREFERRED EMBODIMENTS

Figure 1:
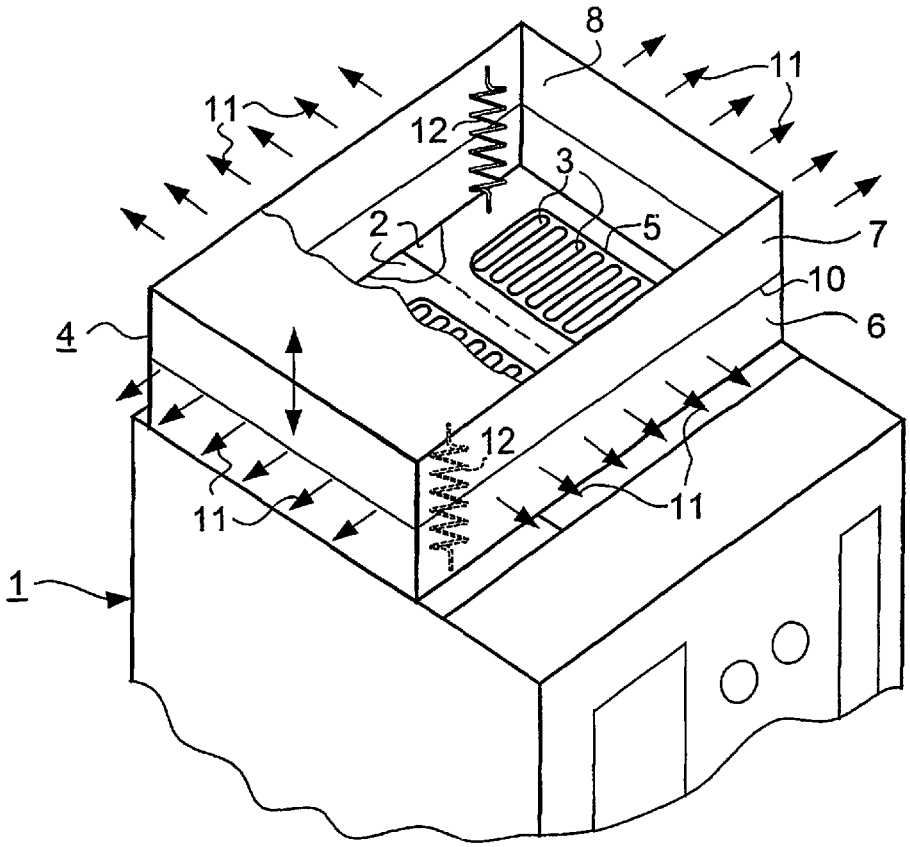
FIG. 1 shows a schematically simplified perspective illustration of a three-pole low-voltage circuit breaker with a blow-out damper.

FIG. 1 shows a cutaway illustration of a three-pole low-voltage circuit breaker 1, whose arc extinguishing chambers 2 have outlet openings 3, which are located on the upper face of the circuit breaker 1, for switching gases which are produced during switching. A switching gas damper 4 is mounted on the circuit breaker 1 and covers the arc extinguishing chamber 2 which is provided, and its outlet openings 3. Separate inlet openings 5 on the switching gas damper 4 ensure that switching gases do not emerge in an uncontrolled manner, that is to say bypassing the switching gas damper 4.

The switching gas damper 4 is composed of two body elements 6 and 7, of which the lower body element 6 is provided with the inlet openings 5 which have been mentioned. Furthermore, the body element 6 is mounted on the circuit breaker 1 in a manner which is not illustrated in any more detail, for example by screws, spring clips or similar devices. The upper body element 7 is seated like a shroud on the lower body element 6 and bounds an internal area 8 into which switching gases which escape from the arc extinguishing chambers 2 flow during switching of the circuit breaker 1. The capability of the upper body element 7 to move relative to the lower body element 6 enlarges the internal area 8 forming a gap 10, which is indicated at the dividing joint between the body elements 6 and 7, through which switching gases can flow out, as is indicated by arrows 11. Since the amount of switching gases which are produced depends on the magnitude of the current to be interrupted in the circuit breaker 1, there may be no outlet flow in circumstances when the switching gases in the internal area 8 are cooled down sufficiently and the volume shrinks in a corresponding manner.

The outlet flow of switching gases from the switching gas damper 4 also depends on the nature and magnitude of the restoring force which is used to prestress the body elements with respect to one another. As a way of providing such an elastic restoring force, FIG. 1 shows springs 12 which are arranged such that they are located diagonally opposite one another and are in the form of helical tension springs. The springs 12 may obviously be of such a size that the body elements 6 and 7 are prestressed to a certain extent, so that a gap 10 is produced for gases to flow out through only when a certain overpressure is reached.

Figure 2:
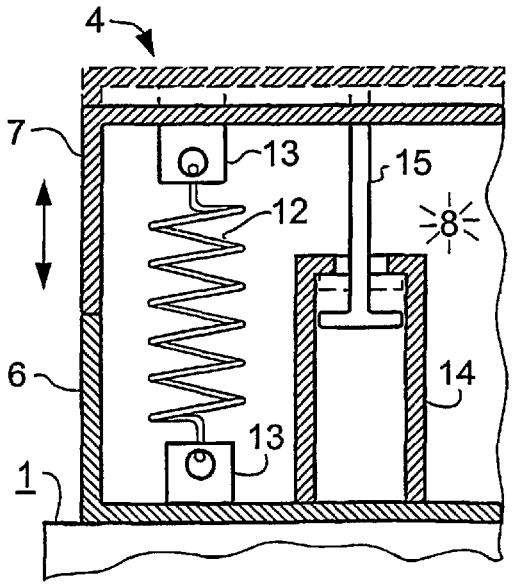
FIG. 2 shows, as a detail of a switching gas damper, a spring arrangement and a stop, which spring arrangement allows the body elements to move in a limited manner with respect to one another.

The springs 12 may, for example, be arranged as shown in FIG. 2. In this case, the figure shows opposing bearings 13 which are fitted to the body elements 6 and 7 and into which end limbs of the springs 12 are hooked. In addition, stops 14, which interact with guide plungers 15, are provided as devices for mutual guidance of the body elements 6 and 7 and for limiting their mutual relative movement. The relative movement of the body elements 6 and 7 is indicated by a double arrow 16 in FIG. 2. The guide plunger 15 rests against the stop 14 in the limit position, which is shown by dashed lines. The spring 12 can thus likewise be extended only to a limited extent, thus giving it the desired characteristics.

Figure 3:
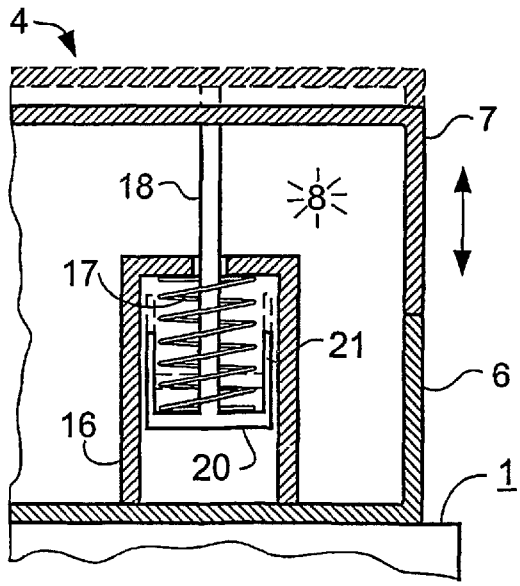
FIG. 3 shows an arrangement with the same effect, in which the spring and stop are combined with one another.

According to FIG. 3, the provision of the elastic restoring force and the function of a stop can be combined in a space-saving manner in one assembly. To do this, an opposing bearing 16 for a spring 17 which is in the form of a helical compression spring at the same time acts as a stop for a guide plunger 18. This itself forms a further opposing bearing for the spring 17, to be precise by use of a spring washer 20. A collar 21 on the spring washer 20 limits the movement of the guide plunger 18. Furthermore, the stop 16 is in the form of a hollow-cylindrical protection body, which makes it impossible for switching gases to act directly on the spring 17.

The stops and guide plungers may be associated as required in the arrangements shown in FIGS. 2 and 3.

The stop 14 and the opposing bearing 16 may thus optionally also be fitted to the upper body element 7, while the guide plungers 15 and 18 originate from the lower body element 6.

In the further exemplary embodiments which will be described in the following text, the body elements are designed, in contrast to the designs in FIGS. 1, 2 and 3, such that they engage telescopically in one another, so that the switching gases are allowed to flow out, depending on the chosen overlap, only when the body elements have already been moved through a certain distance.

Figure 4:
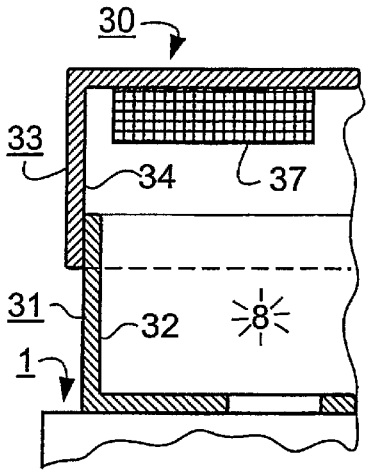
FIGS. 4, 5 and 6 show successive phases of the movement of two body elements, which engage in one another telescopically, of a switching gas damper.

FIG. 4 shows a switching gas damper 30, illustrated in cutaway form, which has a lower body element 31 with walls 32 and an upper body element 33 whose walls 34 engage around the walls 32. The capability for the upper body element 33 to move telescopically is ensured by guidance means which are not shown, for example in a corresponding way to FIG. 2 or 3. If, as indicated by an arrow 35 in FIG. 5, switching gases enter the internal area of the switching gas damper 30, then the body element 33 is raised against the elastic prestress that acts on it, thus correspondingly reducing the overlap of the walls 32 and 34. However, as indicated by arrows 36 in FIG. 6, the switching gases cannot start to flow outward until the body elements 32 and 34 have moved further. The switching gas damper can thus operate as a closed system when the relative movement of the body elements 31 and 33 is correspondingly limited, so that it is not possible to move beyond the position shown in FIG. 5.

Figure 5:
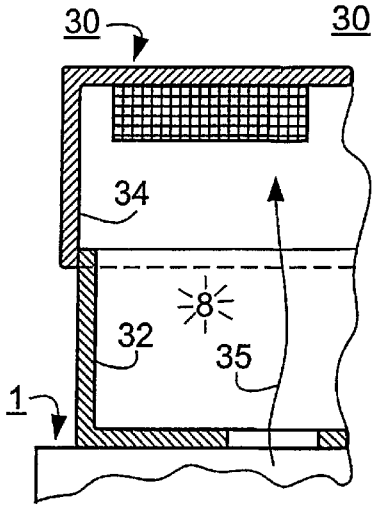
Figure 6:
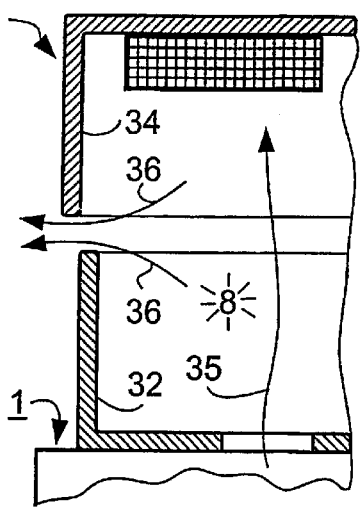

FIGS. 4, 5 and 6 furthermore show a coating, cladding or cushion-like arrangement of a porous material 37 which can absorb switching gases. A material such as this, for example a number of layers of wire mesh, a sintered metal body or a porous ceramic or mineral material, prevents pressure waves from being reflected, and thus contributes to the dissipation of pressure peaks.

Figure 7:
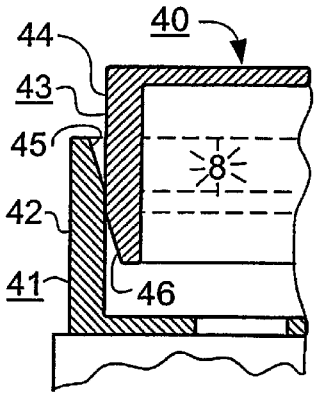
FIGS. 7, 8 and 9 show a further exemplary embodiment in an illustration corresponding to that in FIGS. 4, 5 and 6, in which edge areas of the body elements are provided with inclined surfaces.
Figure 8:
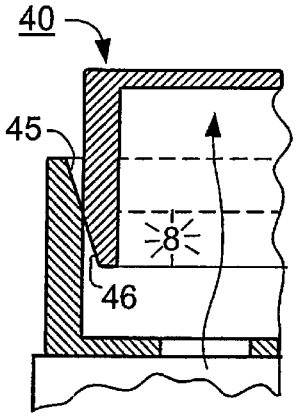
Figure 9:
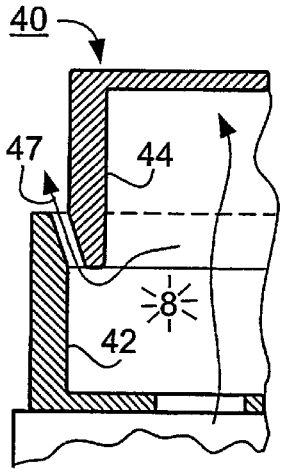

In the further example shown in FIGS. 7, 8 and 9, a switching gas damper 40 once again has a body element 41 with walls 42, and a body element 43 with walls 44, which engage over one another. However, in this case, the lower body element 41 engages over the upper body element 43. Edge areas of the walls 42 and 44 are provided with inclined surfaces 45 and 46, respectively, in the same sense, which, as shown in FIG. 9, form a channel-like outlet opening in order to provide a diversion path for the emerging gases. As is indicated by an arrow 47 in FIG. 9, the majority of the flow is parallel to the walls 44. In this case, after passing the position of the body elements 41 and 43 as shown in FIG. 8, the flow is already aligned as stated, and does not change as the body elements 41 and 43 move further.

Figure 10:
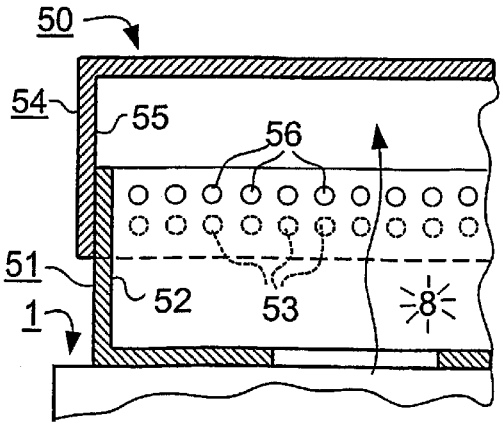
FIGS. 10 and 11 show exemplary embodiments with outlet openings which are formed by differently shaped openings in walls of the body elements.
Figure 11:
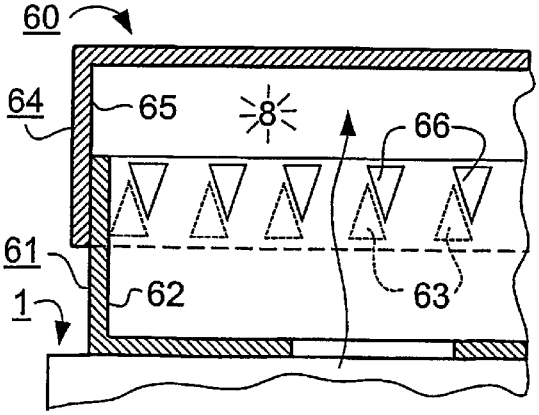

If a diffuse outlet flow of the switching gases is desired, this can be achieved by way of respective switching gas dampers 50 and 60 as shown in FIGS. 10 and 11. The body element 51 used here has walls 52 whose edge areas are provided with circular holes 53. An associated body element 54 has walls 55 whose edge areas likewise contain circular holes 56. When the switching gas damper 50 is in the rest state, an intermediate space is formed between the holes 53 and 56. The switching gas damper is thus closed. When sufficient movement takes place between the body elements 51 and 54, the holes 53 and 54 partially or completely correspond to one another, however, thus producing numerous small outlet openings.

The switching gas damper 60 shown in FIG. 11 has a similar function to the switching gas damper 50 in FIG. 10, but with the holes 63 and 66 in the walls of the body elements 61 and 64 having a different shape. Both the holes 63 and 66 have a triangular shape and are arranged in mirror-image form with a lateral offset in the interacting body elements 61 and 64. Thus, when the body elements 61 and 64 move in the exemplary embodiment as shown in FIG. 11, this leads to the holes 63 and 66 overlapping gradually, with a corresponding increase in the cross section of the outlet openings.

For the purposes of an embodiment of the invention, the springs and stops as shown in FIGS. 2 and 3 may also be used in the same sense or in an equivalent modified form for the exemplary embodiments shown in FIGS. 4 to 6, 7 to 9 and 10 and 11. A reflection-reducing material as shown in FIGS. 4 to 6 may also be used in all the other exemplary embodiments. In this context, it should also be mentioned that the outlet openings which are formed by relative movement of the body elements in the described switching gas dampers can be provided not only over the entire circumference of the switching gas dampers, but also only on specific sides. This makes it possible to keep the switching gases away from specific areas of the environment of the circuit breaker.

For example, instead of the switching gases being dissipated on all sides as shown by the arrows 11 in FIG. 1, if it is desirable for the outlet flow to take place only at the side, then this can be achieved by the body elements 6 and 7 being designed so that they overlap one another at the front and rear to some extent, as shown in FIG. 4. The overlap is preferably of such a size that it remains in existence within the intended relative movement of the body elements.

In the exemplary embodiments shown in FIGS. 10 and 11, an outlet flow of switching gases on one or more desired sides can be achieved by arranging holes 53 and 56, or 63 and 66, only there. The same approach can be adopted in the other described exemplary embodiments.

List of reference symbols

1=Low-voltage circuit breaker
2=Arc extinguishing chamber
3=Outlet opening of the arc extinguishing chamber 2
4=Switching gas damper
5=Inlet opening of the switching gas damper 4
6=(Lower) body element of the switching gas damper 4
7=(Upper) body element of the switching gas damper 4
8=Internal area of the switching gas damper 4
10=Gap between the body elements 6 and 7
11=Arrow for the flow of switching gases
12=Spring (helical tension spring)
13=Opposing bearing for the spring 12
14=Stop
15=Guide plunger
16=Opposing bearing (at the same time a stop and protection body)
17=Spring (helical compression spring)
18=Guide plunger (at the same time a spring mount)
20=Spring washer on the guide plunger 18
21=Collar on the spring washer 20
30=Switching gas damper (FIGS. 4, 5 and 6)
31=(Lower) body element of the switching gas damper 30
32=Wall of the body element 31
33=(Upper) body element of the switching gas damper 30
34=Wall of the body element 33
35=Arrow for incoming switching gases
36=Arrow for emerging switching gases
37=Porous material
40=Switching gas damper (FIGS. 7, 8 and 9)
41=(Lower) body element of the switching gas damper 40
42=Wall of the body element 41
43=(Upper) body element of the switching gas damper 40
44=Wall of the body element 43
45=Inclined surface on the body element 41
46=Inclined surface on the body element 43
47=Arrow for outward-flowing switching gases
50=Switching gas damper (FIG. 10)
51=(Lower) body element of the switching gas damper 50
52=Wall of the body element 51
53=Hole in the wall 52
54=(Upper) body element of the switching gas damper 50
55=Wall of the body element 54
56=Hole in the wall 55
60=Switching gas damper (FIG. 11)
61=(Lower) body element of the switching gas damper 60
62=Wall of the body element 61
63=Hole in the wall 62
64=(Upper) body element of the switching gas damper 60
65=Wall of the body element 64
66=Hole in the wall 65

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A low-voltage circuit breaker, comprising:

an arc extinguishing chamber; and a switching gas damper, adapted to absorb switching gases which emerge from the arc extinguishing chamber, wherein the switching gas damper is detachably mounted on the circuit breaker and includes an inlet opening for switching gases which emerge from an outlet opening in the arc extinguishing chamber, the switching gas damper including two body elements movable relative to one another, wherein a first body element is fitted to the circuit breaker and the other body element is movable against an elastic restoring force relative to the first body element to enlarge an internal area which is enclosed by the body elements.

2. The low-voltage circuit breaker as claimed in claim 1, wherein the switching gas damper includes an outlet opening for switching gases, which can be opened by a relative movement of the body elements.

3. The low-voltage circuit breaker as claimed in claim 2, wherein the body elements of the switching gas damper engage one another telescopically.

4. The low-voltage circuit breaker as claimed in claim 3, wherein edge areas of the mutually overlapping walls of the body elements are provided with inclined surfaces in the same sense in order to form outlet openings which are aligned at least partially parallel to the walls.

5. The low-voltage circuit breaker as claimed in claimed 3, wherein the walls of the body elements of the switching gas damper are provided with openings which do not correspond to one another when the body elements are in the basic position and which correspond to one another at least partially when the body elements are moved relative to one another.

6. The low-voltage circuit breaker as claimed in claim 2, wherein the switching gas damper contains a porous material adaptable to absorb switching gases.

7. The low-voltage circuit breaker as claimed in claim 2, wherein opposing bearings, originating from the body elements, for a spring which prestresses the body elements with respect to one another are arranged in the internal area of the switching gas damper, and wherein a stop is provided in order to limit the relative movement of the body elements.

8. The low-voltage circuit breaker as claimed in claim 7, wherein at least one of the opposing bearings is in the form of a protection body which shields the spring from the internal area of the switching gas damper.

9. The low-voltage circuit breaker as claimed in claim 8, wherein the opposing bearings are at the same time designed as a stop in order to limit the relative movement of the body elements.

10. The low-voltage circuit breaker as claimed in claim 7, wherein the opposing bearings are at the same time designed as a stop in order to limit the relative movement of the body elements.

11. The low-voltage circuit breaker as claimed in claim 1, wherein the body elements of the switching gas damper engage one another telescopically.

12. The low-voltage circuit breaker as claimed in claim 11, wherein edge areas of the mutually overlapping walls of the body elements are provided with inclined surfaces in the same sense in order to form outlet openings which are aligned at least partially parallel to the walls.

13. The low-voltage circuit breaker as claimed in claim 11, wherein the walls of the body elements of the switching gas damper are provided with openings which do not correspond to one another when the body elements are in the basic position and which correspond to one another at least partially when the body elements are moved relative to one another.

14. The low-voltage circuit breaker as claimed in claim 1, wherein the switching gas damper contains a porous material adaptable to absorb switching gases.

15. The low-voltage circuit breaker as claimed in claim 1, wherein opposing bearings, originating from the body elements, for a spring which prestresses the body elements with respect to one another are arranged in the internal area of the switching gas damper, and wherein a stop is provided in order to limit the relative movement of the body elements.

16. The low-voltage circuit breaker as claimed in claim 15, wherein at least one of the opposing bearings is in the form of a protection body which shields the spring from the internal area of the switching gas damper.

17. The low-voltage circuit breaker as claimed in claim 16, wherein the opposing bearings are at the same time designed as a stop in order to limit the relative movement of the body elements.

18. The low-voltage circuit breaker as claimed in claim 15, wherein the opposing bearings are at the same time designed as a stop in order to limit the relative movement of the body elements.

19. A low-voltage circuit breaker, comprising:

an arc extinguishing chamber; and damper means for absorbing switching gases which emerge from the arc extinguishing chamber, wherein the damper means is detachably mounted on the circuit breaker and includes an inlet opening for switching gases which emerge from an outlet opening in the arc extinguishing chamber, the damper means including two body elements movable relative to one another, wherein a first body element is fitted to the circuit breaker and the other body element is movable against an elastic restoring force relative to the first body element to enlarge an internal area which is enclosed by the body elements.

20. The low-voltage circuit breaker as claimed in claim 19, wherein the damper means includes an outlet opening for switching gases, which can be opened by a relative movement of the body elements.

21. The low-voltage circuit breaker as claimed in claim 19, wherein the body elements of the damper means engage one another telescopically.

22. The low-voltage circuit breaker as claimed in claim 21, wherein edge areas of the mutually overlapping walls of the body elements are provided with inclined surfaces in the same sense in order to form outlet openings which are aligned at least partially parallel to the walls.

23. The low-voltage circuit breaker as claimed in claim 21, wherein the walls of the body elements of the damper means are provided with openings which do not correspond to one another when the body elements are in the basic position and which correspond to one another at least partially when the body elements are moved relative to one another.

24. The low-voltage circuit breaker as claimed in claim 19, wherein the damper means contains a porous material adaptable to absorb switching gases.

25. The low-voltage circuit breaker as claimed in claim 19, wherein opposing bearings, originating from the body elements, for a spring which prestresses the body elements with respect to one another are arranged in the internal area of the damper means, and wherein a stop is provided in order to limit the relative movement of the body elements.

26. The low-voltage circuit breaker as claimed in claim 25, wherein at least one of the opposing bearings is in the form of a protection body which shields the spring from the internal area of the damper means.

27. The low-voltage circuit breaker as claimed in claim 25, wherein the opposing bearings are at the same time designed as a stop in order to limit the relative movement of the body elements.

* * * * *